US005466312A

United States Patent [19]

Ward, Jr. et al.

[11] Patent Number: 5,466,312

[45] Date of Patent: Nov. 14, 1995

[54] METHOD FOR MAKING ALUMINUM FOIL AND CAST STRIP STOCK FOR ALUMINUM FOILMAKING AND PRODUCTS THEREFROM

[75] Inventors: Bennie R. Ward, Jr.; Sander A. Levy, both of Richmond, Va.; George A. Sloan, Garland County, Ark.

[73] Assignee: Reynolds Metals Company, Richmond, Va.

[21] Appl. No.: 276,190

[22] Filed: Jul. 15, 1994

Related U.S. Application Data

[63] Continuation-in-part of Ser. No. 3,075, Jan. 11, 1993, abandoned.

[51] Int. Cl.[6] ..... C22F 1/04; C22C 21/00

[52] U.S. Cl. ..... 148/551; 148/538; 148/552; 148/695; 148/696; 148/438; 420/528; 420/537; 420/538

[58] Field of Search ..... 148/538, 551, 148/552, 695, 696, 438; 420/528, 537, 538

[56] References Cited

U.S. PATENT DOCUMENTS

| | | | |
|---|---|---|---|
| 3,397,044 | 8/1968 | Bylund | 420/550 |
| 3,697,260 | 10/1972 | Hunsicker et al. | 420/537 |
| 4,800,133 | 1/1989 | Arai et al. | 148/438 |
| 5,186,235 | 2/1993 | Ward, Jr. | 148/552 |

FOREIGN PATENT DOCUMENTS

| | | |
|---|---|---|
| 47-16310 | 9/1972 | Japan . |
| 57-188659 | 11/1982 | Japan . |
| 1444153 | 7/1976 | United Kingdom . |

OTHER PUBLICATIONS

"Registration Record of Aluminum Association Designations and Chemical Composition Limits for Wrought Aluminum and Wrought Aluminum Alloys", The Aluminum Association, Inc., Washington, D.C., pp. 1–15, Jan. 1989.

*Primary Examiner*—David A. Simmons
*Assistant Examiner*—Robert R. Koehler
*Attorney, Agent, or Firm*—Robert C. Lyne, Jr.

[57] ABSTRACT

A method for making aluminum foil comprises providing an aluminum-based alloy composition consisting essentially of about 0.05 to 0.20 weight percent silicon, about 0.02 to 0.50 weight percent iron, about 0.05 to 0.30 weight percent copper and balance aluminum and inevitable impurities and grain refining elements, wherein the ratio of iron to silicon ranges between about 2:1 and 4:1. The aluminum-alloy composition is continuously cast using a unitary and chilled casting wheel to form a cast strip product of desired width and gauge. The cast strip product is then homogenized, cold rolled and recrystallized annealed into an aluminum foil product. The aluminum-based alloy composition produces a single roll cast product having minimum microshrinkage porosity on the air surface thereof. Reducing or eliminating the microshrinkage porosity in the cast product results in an aluminum foil product having a minimum of pinholes in the final foil product.

19 Claims, 1 Drawing Sheet

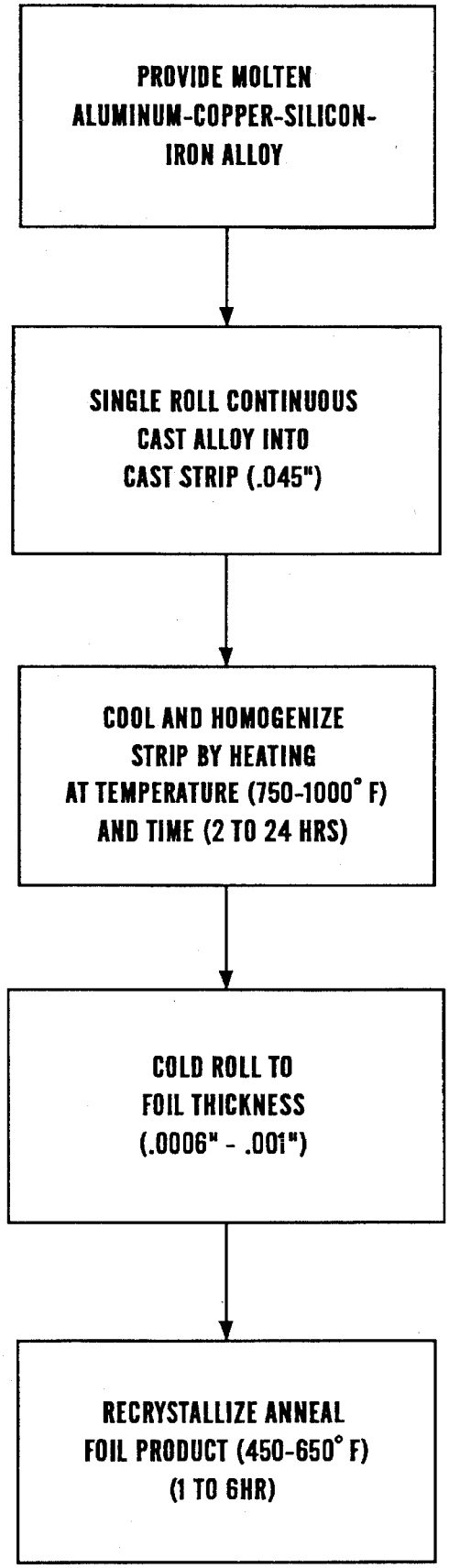
PROVIDE MOLTEN ALUMINUM-COPPER-SILICON-IRON ALLOY
SINGLE ROLL CONTINUOUS CAST ALLOY INTO CAST STRIP (.045")
COOL AND HOMOGENIZE STRIP BY HEATING AT TEMPERATURE (750-1000° F) AND TIME (2 TO 24 HRS)
COLD ROLL TO FOIL THICKNESS (.0006" - .001")
RECRYSTALLIZE ANNEAL FOIL PRODUCT (450-650° F) (1 TO 6HR)

METHOD FOR MAKING ALUMINUM FOIL AND CAST STRIP STOCK FOR ALUMINUM FOILMAKING AND PRODUCTS THEREFROM

This is a continuation-in-part application of Ser. No. 08/003,075, filed Jan. 11, 1993, now abandoned.

FIELD OF THE INVENTION

The present invention is directed to a method of making aluminum foil utilizing a single roll continuous casting method and an aluminum-based alloy composition which can be single roll cast, homogenized, cold rolled and annealed to produce an aluminum foil product.

BACKGROUND ART

In the prior art, it is known to produce aluminum in coil form from a single or unitary roll continuous casting apparatus wherein molten aluminum is delivered from a tundish and cast in the form of a metal sheet or strip and wound onto a coiler. Generally, in this process, molten aluminum is deposited on a moving chill surface from a tundish having an open outlet. An inlet is provided for the flow of molten metal into the tundish from a source of molten metal. The direct casting of the molten aluminum metal onto a chill wheel, preferably a grooved chill wheel, produces a cast aluminum product at a rapid rate. The aluminum cast strip is wound on a coiler in heated form, generally at a temperature in the range of about 400°–1000° F.

Drag casting apparatus and methods of this type are described, for example, in U.S. Pat. Nos. 4,828,012, 4,896,715, 4,934,443, 4,945,974, 4,940,077 and 4,955,429. The disclosures of these patents are hereby specifically incorporated by reference with respect to the method and apparatus for the production of aluminum strip and coil from molten aluminum or aluminum alloys.

In the manufacture of aluminum foils, typically, an AA8111 aluminum alloy is twin roll cast, cold rolled, homogenized, cold rolled and final annealed to produce a aluminum foil product. These alloys contain about 0.56 wt. % silicon and 0.67 wt. % iron and are rolled to final gauges ranging between 0.00066 inches and 0.0009 inches. As is well known in the art, these types of alloys are usually formed by adding silicon and iron to high impurity aluminum. For purposes of aluminum foil manufacture, the starting aluminum material has an impurity content of copper which is essentially zero, for example, 0.004 weight percent copper or less.

With regard to impurity levels in aluminum alloys, it is also well known that the Aluminum Association designations for chemical composition limits for wrought aluminum and wrought aluminum alloys identifies impurity limits in terms of a maximum tolerable amount (i.e. limits) for a specific element. These limits reflect a judgement of what can be tolerated for a particular alloy while still providing an acceptable alloy. However, these Aluminum Association designations do not set forth the quantities of impurities actually present or expected to be present in an alloy.

Generally, aluminum foils are designated as rolled products less than 0.006 inches in thickness and having a rectangular cross section. However, attempts at single roll or drag casting of AA8111 alloys have,been unsuccessful. When the AA8111 alloy is drag cast and rolled to foil gauge, an unacceptable level of pinholes are present and the foil is stiff. Even using higher homogenization temperatures and obtaining recrystallization during the final anneal, unacceptable levels of pinholes are still present in the AA8111 drag cast foil. In view of the inherent advantages of drag casting over twin roll casting, e.g., increased casting speed, increased productivity and a decrease in required cast strip thickness cold reduction, a need has developed to provide a method and alloy composition capable of being single roll or drag cast and further reduced into an acceptable aluminum foil product.

In response to this need, the present invention provides a method of making an aluminum foil product and a cast strip stock for foil making which utilizes an aluminum-based alloy composition which, when single roll cast, provides an acceptable product for aluminum foil making. The inventive method and product utilize an aluminum-based alloy composition containing critical amounts of iron, silicon and copper which provides a narrow freezing band range during single roll casting and produces a cast strip having a minimum of microshrinkage porosity and a foil having minimal pinholes resulting in an acceptable quality single roll cast strip and aluminum foil product produced therefrom.

SUMMARY OF THE INVENTION

It is accordingly one object of the present invention to provide a method of making a single roll cast strip product for aluminum foil making and a method of making an aluminum foil product.

It is another object of the present invention to provide an aluminum foil product derived from single roll casting as well as a single roll cast strip stock product for subsequent aluminum foil making.

It is a further object of the present invention to provide a heat treatable aluminum-based alloy composition capable of producing an acceptable grade of aluminum foil product having sufficient flexibility and surface quality.

Another object of the present invention is to provide an aluminum-based alloy composition that can be single roll cast and further processed through homogenization, cold rolling and final annealing to produce a foil product.

These and other objects and advantages of the present invention will become apparent as the description thereof proceeds.

In satisfaction of the foregoing objects and advantages, the present invention provides a method of making an aluminum foil comprising the steps of providing a molten aluminum-based alloy consisting essentially of about 0.05 to 0.20 weight percent silicon, about 0.20 to 0.50 weight percent iron, about 0.05 to 0.30 weight percent copper with the balance aluminum and inevitable impurities, the impurity level being less then about 0.15 weight percent in total and the ratio of iron to silicon between about 2:1 and 4:1. Making the molten aluminum based alloy includes the step of adding copper to a starting alloy in a sufficient amount to increase the starting alloy's copper content to about 0.05 to 30 wt. %.

The aluminum-alloy composition is continuously cast on a unitary rotating and cooled casting wheel to form a coiled cast strip. The coiled cast strip is homogenized at a time and temperature prior to cold rolling. The cast strip is generally cast to a thickness of approximately 0.040 to 0.050 inches.

The homogenized cast strip is cold rolled down to a foil thickness ranging between 0.0003 and up to 0.006 inches, preferably followed by a final recrystallizing anneal.

The present invention also provides an aluminum foil having the aluminum-based alloy composition recited above and a single roll cast strip product as stock material for aluminum foil making. The cast strip stock product may be homogenized and cold rolled to known foil thickness gauges prior to the final recrystallizing anneal. In a preferred method, the aluminum alloy to be cast consists essentially of 0.06 to 0.12 weight percent silicon, 0.2 to 0.4 weight percent iron, 0.17 to 0.26 weight percent copper, the balance being aluminum and inevitable impurities and an iron to silicon ratio of about 3:1. A preferred thickness for the aluminum foil ranges between 0.0006 and 0.0007 inches.

BRIEF DESCRIPTION OF DRAWINGS

Reference is now made to the drawing accompanying the application wherein the sole FIGURE is a schematic block diagram of an exemplary method of making the cast strip stock material and aluminum foil according to the invention.

DESCRIPTION OF THE PREFERRED EMBODIMENTS

With reference to the sole figure, one embodiment of the inventive method of making an aluminum foil product is illustrated. Therein, a molten aluminum-copper-silicon-iron alloy is provided and single roll continuously cast into a cast strip. The aluminum-copper-silicon-iron alloy has a composition, in its broadest embodiment, consisting essentially of about 0.05 to 0.20 weight percent silicon, about 0.20 to 0.50 weight percent iron, about 0.05 to 0.30 weight percent copper with the balance aluminum and other inevitable impurities and known grain refining elements. The impurity levels and grain refining elements in total should not exceed about 0.15 weight percent with individual impurity elements and grain refining alloying components typically found in aluminum alloys such as manganese, magnesium, chromium, nickel, zinc and titanium not exceeding 0.05 weight percent individually. The ratio of iron to silicon for the aluminum alloy composition should be between about 2:1 and 4:1.

In a more preferred embodiment of the invention, the aluminum alloy composition to be single roll cast for making stock or foil product consists essentially of about 0.06 to 0.1 2 weight percent silicon, 0.2 to 0.4 weight percent iron and about 0.17 to 0.26 weight percent copper, with the iron to silicon ratio being about 3:1.

In a most preferred embodiment, the silicon should be about 0.1 weight percent, iron being about 0.3 weight percent, and copper being 0.2 weight percent. As will described hereinafter, the combination of silicon, iron and copper in the aluminum-based alloy composition provides properties which enable the molten aluminum-based alloy composition to be single roll continuously cast to produce a single roll cast strip product that can be further processed into an acceptable aluminum foil product.

The aluminum-based alloy composition is made by adding the copper as an alloying element to molten aluminum, since the grades of pure aluminum used for making the composition are essentially copper-free or have very low copper values (e.g., 0.004 weight percent or less), and as a practical matter scrap or scrap-based aluminum which already contains a sufficient amount of copper will also contain excessive levels of silicon and/or iron.

Referring again to the sole figure, the molten aluminum-based alloy composition is single roll continuously cast into a cast strip product, preferably using the drag casting method and apparatus discussed above and herein incorporated by reference. In drag casting of aluminum alloys, the cast strip product is cast in various widths with thickness ranging between 0.030 and 0.070 inches, preferably, 0.040 and 0.050 inches. A more preferred cast strip thickness includes 0.045 inches. Cast strip widths may vary up to about 80 inches in width.

The cast strip product is suitable as an aluminum foil stock material to be further processed into aluminum foil product. Using the aluminum-copper-silicon-iron alloy described above, a drag cast strip product is produced having an improved surface quality with reduced microshrinkage porosity. This reduction in microshrinkage porosity permits the cast strip product to be further reduced in multiple cold rolling passes to foil thickness without generation of excessive pinholes which are detrimental to foil product quality.

It is believed that the difference in the freezing range of the prior art AA8111 aluminum alloy composition and the inventive aluminum alloy composition contributes to the reduction in microshrinkage porosity and pinholes in the inventive aluminum foil product. For an AA8111 alloy, the melting range is from about 1176° F. to 1217° F., a melting range of about 41° F. This wide range is due to the relatively large silicon content for this type alloy, typically, 0.5 weight percent silicon. In contrast, the inventive alloy composition, with only about 0.1 percent silicon and about 0.4 percent iron has a melting range of between 1207° F. and 1220° F., i.e. about 13° F., without copper and between about 1199° F. to 1219° F., i.e. about 20° F. with about 0.25 weight percent copper. Thus, the melting or freezing range of the inventive aluminum-based alloy composition is roughly one half of that of the AA8111 alloy composition. Moreover, from this comparison, the presence of copper does not adversely effect the melting range since the melting range only increases 5° F. for a 0.25 addition of copper to the aluminum alloy containing 0.1 weight percent silicon and 0.4 weight percent iron.

The decrease in the freezing or melting range of the inventive alloy reduces or effectively eliminates microshrinkage porosity in the drag cast product and pinholes in foil produced therefrom.

Since the freezing range is related to the silicon content, i.e. increasing silicon increases the freezing or melting range, the silicon content of the aluminum alloy to be single roll cast should be kept below 0.20 weight percent to avoid excessive microshrinkage porosity in the drag cast strip product. However, a minimum amount of silicon is required, i.e., about 0.05 weight percent to achieve the necessary constituent size and distribution during the homogenization anneal step to permit subsequent cold rolling steps to provide the necessary dislocation sites for recrystallization upon final anneal.

In conjunction with the lower levels of silicon in the drag cast aluminum alloy composition is the relationship between iron and silicon amounts. It was discovered that maintaining high levels of iron with reduced levels of silicon prevented recrystallization from occurring in the final annealed product. For example, an alloy composition having 0.1 weight percent silicon, 0.65 weight percent iron, 0.08 weight percent copper with the balance aluminum was drag cast, homogenized at 4 hours at 950° F. and recrystallized annealed at 500° F. at a foil gauge thickness of 0.00065 inches. However, recrystallization did not occur. Increasing the recrystallization annealing temperature did not facilitate any recrystallization. In a comparative test, and using the same homogenization and recrystallization parameters, an alloy of the same chemistry but with only 0.4 percent iron exhibited recrystallization, showing a grain size of between 5.5 and 60.5. Increasing the recrystallization anneal temperature to 600° F. also resulted in a recrystallized foil product having a grain size between 5 and 6.

From this comparison, excessive levels of iron and silicon result in difficulties in recrystallization and pinhole occurrence, respectively. Increasing amounts of iron also contribute to pinhole occurrence in the foil drag cast product. It should also be noted that iron is added for strength in the final foil product. Insufficient levels of iron, i.e., below 0.2 weight percent results in a foil product having insufficient strength. Thus, the iron content should be maintained within the disclosed iron and silicon ratio as well as between the disclosed weight percentages for iron.

The copper component of the inventive aluminum-alloy composition provides benefits with respect to the freezing range, solid solution strengthening, corrosion resistance and cast surface quality. As demonstrated above, additions of copper do not excessively increase the melting range and do not adversely affect the single roll or drag casting process. In addition, the copper provides solid solution strengthening which effectively offsets strength losses in the cast foil making stock product and foil product as a result of a reduction in iron content. It is also been observed that the increased copper content contributes to a smoother continuous cast surface when releasing from the casting wheel which reduces the amount of slivering in the cast strip product. Moreover, strengths equivalent to twin roll cast AA8111 are attainable with the copper addition while maintaining an acceptable level of pinhole occurrence. Finally, the copper addition permits maintaining a low iron to silicon ratio which facilitates recrystallization annealing in the 450° F. to 650° F. range along with homogenization in the 750° F. to 1000° F. range.

With reference again to the sole figure, the single roll continuously cast strip is cooled and homogenized by heating. The homogenization achieves the desired microstructural constituent size and distribution to permit subsequent cold rolling steps to provide dislocation sites for the final recrystallization. A broad range of homogenization times and temperatures include 750 to 1000° F. for 2 to 24 hours. A more preferred range includes about 850 to 900° F. for about 4 to 6 hours. An additional cold rolling step may be performed prior to homogenization. For example, a cast strip of about 0.045 inches thickness could be cold rolled to about 0.022 inches prior to homogenization. However, it is preferred to homogenize the cast strip, homogenization at this gauge permitting increased cold roll reduction and a finer grain size in the foil product.

Following the homogenization step, the homogenized strip is further cold rolled on a foil mill to a final gauge foil thickness ranging between 0.0003 and about 0.006 inches. A preferred thickness range for regular duty foil ranges between 0.0006 and 0.0007 inches with a most preferred target of 0.00066 inches. For a heavier duty foil, a preferred target gauge is 0.0009 inches.

Following the final multiple cold rolling steps, the foil product is annealed to form a recrystallized grain structure. The recrystallization anneal may range between 450° F. to 600° F. and from between about 1 and 6 hours. A preferred recrystallization anneal includes 550° F. for about 2 hours.

It should be understood that the times and temperatures given for the homogenization and recrystallization anneal are exemplary of the preferred embodiments of the invention. Variations in times and temperatures given the disclosed ranges of copper, silicon and iron for the inventive alloy composition are considered to be within the skill of the artisan.

To further demonstrate the improvements associated with the invention, the Table shows a comparison between aluminum alloy foils according to the invention, an AA8111 alloy and an non-recrystallizable alloy chemistry. It should be noted that the examples shown in the Table are presented to illustrate the invention, but the invention is not to be considered as limited thereto. Moreover, the percentages of alloy components are in weight percent unless otherwise specified.

TABLE

| DESIGNATION | ALLOY CHEMISTRY | GAUGE | THERMAL PRACTICE | GRAIN SIZE | PIN HOLES/ $Ft^2$ |
|---|---|---|---|---|---|
| A | .1 Si .66 Fe .23 Cu | .00065" | 4 hr. 950° F. (homo.), rolled and 550° F. recryst. anneal | NR | 130 |
| B(8111) | .56 Si .67 Fe | .00066" | Same as above | NR | 1275 |
| C* | .06 Si .30 Fe .19 Cu | .00066" | 6 hr. 900° F. (homo.) rolled and 550° F. recryst. anneal | 6.0 | 7.8 |
| D* | .06 Si .31 Fe .18 Cu | .00067" | 6 hr. 930° F. (homo.) rolled and 550° F. recryst. anneal | 6 | 10.0 |
| E* | .06 Si .30 Fe .25 Cu | .00066" | 6 hr. 900° F. (homo.) rolled and 550° F. recryst. anneal | 6 | 14.6 |

*According to invention; NR = Not Recrystallized

In the Table, the aluminum alloy chemistry according to the invention is designated as C, D, and E. Alloy B corresponds to the prior art AA8111 alloy with alloy designation A depicting an alloy chemistry incapable of recrystallization.

Each of the alloy designations listed in the Table were melted and drag cast into a cast strip form using conventional drag casting techniques as described above. The cast strip was cooled and cold rolled to an intermediate gauge. The homogenization practice and recrystallization annealing practice for each alloy is shown under the thermal practice column.

As is evident from the Table, the prior art AA8111 alloy did not recrystallize and showed an excessive level of pinholes per square foot. In a similar manner, alloy A, having a high iron to silicon ratio and high iron content, did not recrystallize and had an unacceptable level pinholes at the final gauge.

In contrast, each of the alloy chemistries according to the invention showed a recrystallized grain size of about 6 and an acceptable level of pinhole content. Thus, the Table demonstrates that the alloy chemistry of the invention can be successfully drag cast into a cast strip product having sufficient cast strip product quality without microshrinkage porosity which can be further processed into an aluminum foil product without a detrimental level of pinhole content.

Although the invention has been described for drag casting of aluminum alloys, it is believed that any single or unitary chilled wheel continuous casting method for aluminum alloys wherein the molten metal is cast such that only one surface thereof is in contact with a heat transfer medium is adaptable for use with the present invention.

As such, an invention has been disclosed in terms of preferred embodiments thereof which fulfill each and every object of the present invention as set forth hereinabove and provide a new and improved method for making aluminum foil and continuously cast strip stock for foil making and products thereof.

Various changes, modifications and alterations from the teachings of the present invention may be contemplated by those skilled in the art without departing from the intended spirit and scope thereof. Accordingly, it is intended that the present invention only be limited by the terms of appended claims.

What is claimed is:

1. An aluminum foil having an aluminum alloy composition consisting essentially of:

about 0.08 to 0.20 wt. % silicon;

about 0.24 to 0.50 wt. % iron;

about 0.21 to 0.30 wt. % copper; with the balance being aluminum and inevitable impurities, said impurities being less than about 0.15 total wt. % and the ratio of iron to silicon between 3:1 and 4:1.

2. The foil of claim 1 wherein said silicon is about 0.08 to 0.12 wt. %, said iron is about 0.24 to 0.4 wt. % and said copper is about 0.21 to 0.26 wt. %.

3. The foil of claim 2 wherein said silicon is about 0.1 wt. %, said iron is about 0.3 wt %, and said copper is about 0.21 wt. %.

4. The foil of claim 1 wherein said foil has a thickness ranging between about 0.0003 to 0.006 inches.

5. The foil of claim 4 having a thickness of about 0.00066 inches.

6. A method of making an aluminum foil comprising the steps of:

a) providing a molten aluminum-based alloy consisting essentially of:
about 0.08 to 0.20 wt. % silicon;
about 0.24 to 0.50 wt. % iron;
about 0.21 to 0.30 wt. % copper; with
the balance being aluminum and inevitable impurities, said impurities being less than about 0.15 total wt. % and the ratio of iron to silicon being between about 3:1 and 4:1 b) wherein said providing step includes adding copper in an amount sufficient to increase the copper content of a starting alloy to about 0.21 to 0.30 wt. %;

c) continuously casting said molten aluminum alloy on a unitary rotating and cooled casting surface to form a cast strip;

d) heating said cast strip at a time and temperature for homogenization;

e) cold rolling said homogenized strip to a foil having a thickness range between 0.0003 and 0.006 inches; and f) recrystallization annealing said foil.

7. The method of claim 6 wherein said heating step ranges between 750° F. and 1000° F. for about 2 to 24 hours and said recrystallizing annealing steps ranges between about 450° F. and 650° F. for about 1 to 6 hours.

8. The method of claim 6 wherein said molten aluminum alloy consists essentially of:

0.08 to 0.12 wt. % silicon;

0.24 to 0.4 wt. % iron;

0.21 to 0.26 wt. % copper; with the balance aluminum and said inevitable impurities.

9. The method of claim 8 wherein said silicon is about 0.1 wt. %, said iron is about 0.3 wt. %, and said copper is about 0.21 wt. %.

10. The method of claim 6 wherein said continuous casting step casts a strip having a thickness ranging between about 0.040 and 0.050 inches.

11. A single roll cast strip for stock material in aluminum foil making having an aluminum alloy composition consisting essentially of:

about 0.08 to 0.20 wt. % silicon;

about 0.24 to 0.50 wt. % iron;

about 0.21 to 0.30 wt. % copper; and the balance aluminum and inevitable impurities, said impurities being less than 0.15 total wt. % and the ratio of iron to silicon being between about 3:1 and 4:1, said single roll cast strip having a thickness range between 0.030 and 0.070 inches.

12. The strip of claim 11 wherein said silicon is about 0.08 to 0.12 wt. %, said iron is about 0.24 to 0.4 wt. % and said copper is about 0.21 to 0.26 wt. %.

13. The strip of claim 12 wherein said silicon is about 0.1 wt. %, said iron is about 0.3 wt. %, and said copper is about 0.21 wt. %.

14. The strip of claim 11 wherein said strip has a thickness of about 0.045 inches.

15. The strip of claim 11 having a width ranging up to about 80 inches.

16. A method of making an aluminum alloy cast strip as stock for aluminum foil making comprising the steps of:

a) providing a molten aluminum-based alloy consisting essentially of:
about 0.08 to 0.20 wt. % silicon;
about 0.24 to 0.50 wt. % iron;
about 0.21 to 0.30 wt. % copper; with
the balance aluminum and inevitable impurities, said impurities being less than 0.15 total wt. % and the ratio of iron to silicon being between about 3:1 and 4:1;

b) wherein said providing step includes adding copper in an amount sufficient to increase the copper content of a starting alloy to about 0.21 to 0.30 wt. %;

c) continuously casting said molten aluminum alloy on a unitary rotating and cooled casting surface to form a cast strip, said cast strip having a thickness range between 0.030 and 0.070 inches.

17. The method of claim 16 wherein said molten aluminum alloy consists essentially of:

0.08 to 0.12 wt. % silicon;

0.24 to 0.4 wt. % iron;

0.21 to 0.26 wt. % copper; with the balance aluminum and said inevitable impurities.

18. The method of claim 17 wherein said silicon is about 0.1 wt. %, said iron is about 0.3 wt. %, and said copper is about 0.21 wt. %.

19. The method of claim 16 wherein said continuous casting step casts a strip having a thickness of about 0.045 inches.

* * * * *